US005822880A

United States Patent [19]

Puumalainen

[11] Patent Number: 5,822,880

[45] Date of Patent: Oct. 20, 1998

[54] METHOD AND ARRANGEMENT FOR UTILIZING CONDENSATION WATER OF DRYING APPARATUS FOR FIBRE WEB

[75] Inventor: Jarmo Puumalainen, Tampere, Finland

[73] Assignee: Valmet Corporation, Helsinki, Finland

[21] Appl. No.: 832,728

[22] Filed: Apr. 11, 1997

[30] Foreign Application Priority Data

Apr. 12, 1996 [FI] Finland ..... 961638

[51] Int. Cl.[6] ..... F26B 13/26

[52] U.S. Cl. ..... 34/95; 34/392; 34/417; 34/624

[58] Field of Search ..... 34/65, 95, 624, 34/71, 242, 393, 392, 417, 418

[56] References Cited

U.S. PATENT DOCUMENTS

| | | | |
|---|---|---|---|
| 4,112,586 | 9/1978 | Lehtinen et al. | 34/9 |
| 4,461,095 | 7/1984 | Lehtinen | 34/41 |
| 4,506,457 | 3/1985 | Lehtinen et al. | 34/41 |
| 4,887,362 | 12/1989 | Rautakorpi et al. | 34/41 |
| 4,958,444 | 9/1990 | Rautakorpi et al. | 34/71 |
| 5,471,765 | 12/1995 | Rautakorpi et al. | 34/242 |
| 5,566,472 | 10/1996 | Lehtinen et al. | 34/242 |
| 5,706,587 | 1/1998 | Lehtinen et al. | 34/71 |
| 5,722,182 | 3/1998 | Lehtinen et al. | 34/418 |

FOREIGN PATENT DOCUMENTS 92735 8/1994 Finland .

*Primary Examiner*—Henry A. Bennett
*Assistant Examiner*—Pamela A. Wilson
*Attorney, Agent, or Firm*—Ladas & Parry

[57] ABSTRACT

A method and an arrangement for utilizing condensation water of an apparatus for drying a fibre web. The drying apparatus comprises two endless bands (1, 2) that are impermeable to air and that have a good thermal conductivity. A fibre web (5) runs between the bands (1, 2) with at least one felt or wire (3, 4). The metal band in contact with the fibre web (5) is heated with a pressure chamber (9) containing a pressure medium that is steam. Correspondingly, the metal band in contact with the felt is cooled. Water that has evaporated from the fibre web (5) and then condensed is gathered from the wire (4) and this condensate is made suitable for use in a power station by means of the removal of solid matter, so that the condensate can be utilized.

10 Claims, 2 Drawing Sheets

Figure 1:
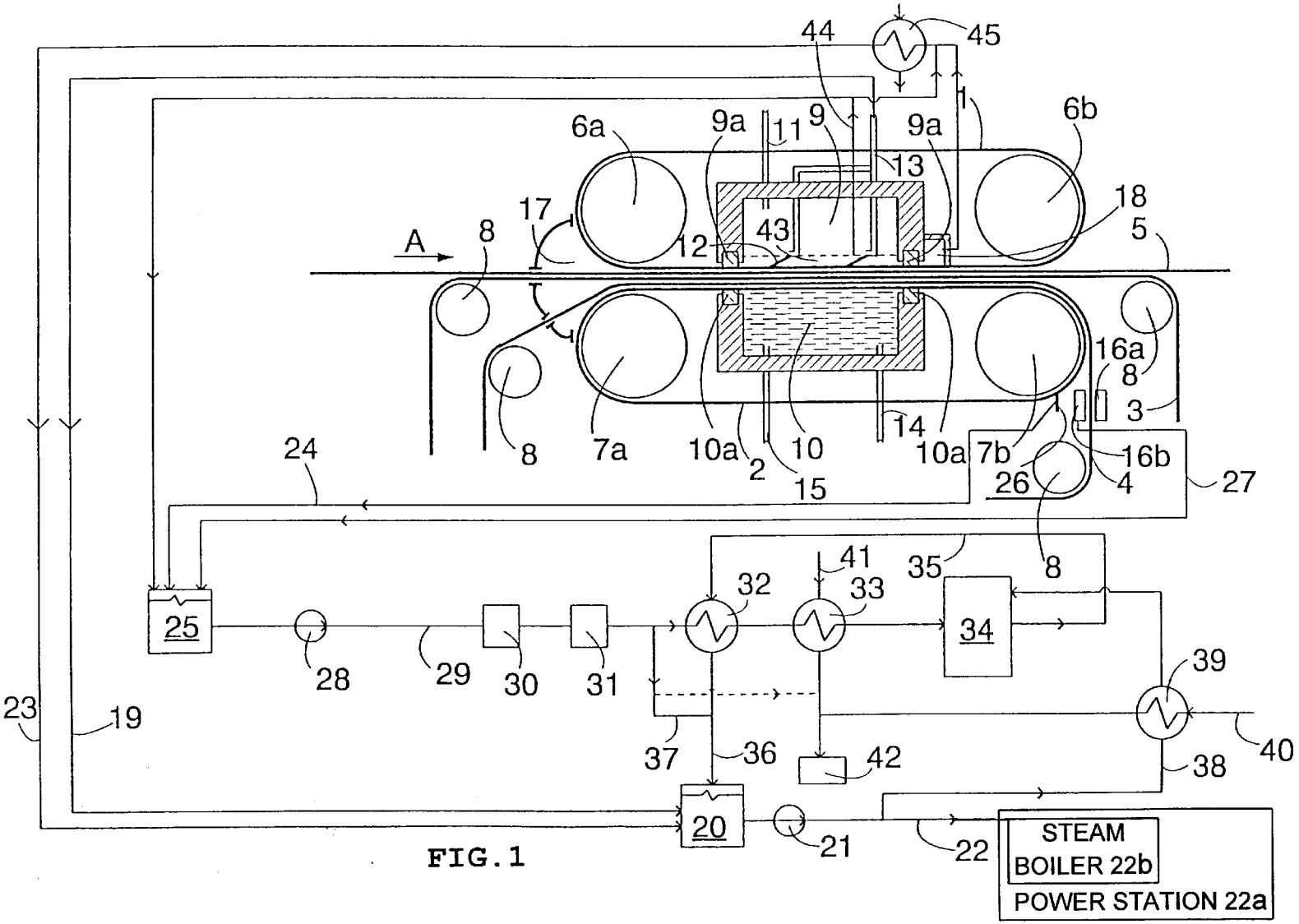

METHOD AND ARRANGEMENT FOR UTILIZING CONDENSATION WATER OF DRYING APPARATUS FOR FIBRE WEB

The invention relates to a method for utilizing condensation water of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, and a pressure chamber containing a pressure medium that is steam, the pressure chamber being arranged to heat the first band, whereby the second band is cooled and the fibre web and at least one felt or wire run between the bands in such a way that the fibre web is in contact with the heated first band and the felt or wire is correspondingly situated between the fibre web and the cooled second band, and that the water that has evaporated from the fibre web and then condensed is recovered.

The invention also relates to an arrangement for utilizing condensation water of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, and a pressure chamber containing a pressure medium that is steam, the pressure chamber being arranged to heat the first band, whereby the second band is cooled and the fibre web and at least one felt or wire run between the bands in such a way that the fibre web is in contact with the heated first band and the felt or wire is correspondingly situated between the fibre web and the cooled second band, the arrangement comprising suction boxes for removing condensate from the felt or wire.

Finnish publication 61537 discloses a method and equipment where a fibre web is dried between two continuously moving metal bands in such a way that a fibre web runs between the bands together with a dryer felt, so that the metal band touching the web has been heated and the metal band touching the felt has correspondingly been cooled. In such a case, water contained in the web vaporizes under the influence of the hot metal band and passes to the felt due to the pressure of the steam, simultaneously pushing water in front of it, and the steam transferred to the felt condenses due to the effect of the cold cooled band, whereupon water passes from the web to the felt and the web is dried. The hot metal band is heated by means of a steam chamber. The drying apparatus further comprises condensate removers with which condensate is removed from the steam chamber from the surface of the heated band. However, the reference does not disclose any use for the condensate after it has been removed and the condensate is mixed with waste water.

Finnish patent 92735 also discloses a similar apparatus for drying a fibre web. This reference further discloses a steam and condensate recovery chamber provided in association with the seal at the end of the steam chamber where the metal bands come into sight from between the heating and the cooling chamber. The steam and condensate that escape from the steam chamber from between the seal and the heated band can be gathered to the steam and condensate recovery chamber. This reference does not disclose any methods of processing the condensate, either, and the condensate is also mixed with waste water here.

Mixing condensation water with waste water naturally increases the amount of waste water. Further, the thermal energy contained in the condensation water is completely wasted when the condensation water is mixed with waste water.

The purpose of the present invention is to provide a method and an arrangement for utilizing condensate produced in an apparatus for drying a fibre web.

The method according to the invention is characterized in that the water that has evaporated from the fibre web and then condensed is supplied for use after the removal of solid matter.

Further, the arrangement according to the invention is characterized in that the arrangement comprises means for conducting the condensate to means for removing solid matter and from there for use.

The essential idea of the invention is that the condensate obtained from the fibre web is supplied for use after the removal of solid matter. Further, the idea of a preferred embodiment is that the condensate collected from the surface of the heated band in the pressure chamber of the apparatus for drying a fibre web is used as feed water in a steam boiler of a power station. The idea of another preferred embodiment is that the condensate that can be collected via the side chambers is utilized. The idea of a third preferred embodiment is that the condensation water is passed through an ion exchanger in addition to the removal of solid matter.

The invention has the advantage that the condensate that has previously evaporated from the fibre web or that has been mixed with waste water can now be utilized, so that for example the amount of waste water decreases. Another advantage of the invention is that pure warm water can be supplied at a low price to a power station, for example, so that energy costs are also reduced. Yet another advantage of the invention is that the water conducted to a power station does not have to be purified with a complicated process and expensive equipment compared to, for example, the preparation of power station water from raw water. With the present method it is possible to produce more condensation water suitable for use in a power station than the drying section of the apparatus uses live steam, which means that simpler and less expensive equipment can be used than during the preparation of condensation water from raw water.

Figure 2:
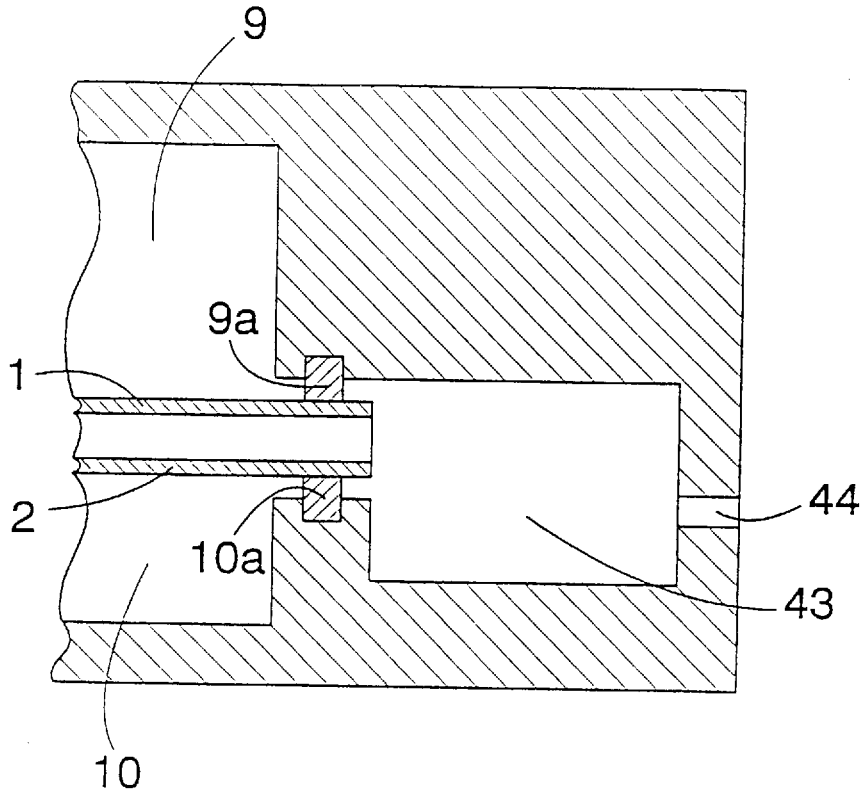

The invention will be described in greater detail in the accompanying drawings, in which FIG. 1 is a schematic side view, in cross-section, of an apparatus for drying a fibre web and of an arrangement according to the invention provided in association with the apparatus, and FIG. 2 is a schematic cross-section of the edge of an apparatus for drying a fibre web, made in the direction of travel of the fibre web.

FIG. 1 is a schematic side view of a drying apparatus according to the invention in a section made in the direction of travel of the web. The drying apparatus comprises an endless first band 1 or upper band and an endless second band 2 or lower band, which are impermeable to air and have a good thermal conductivity, being preferably made of metal. A fine wire or felt 3, a coarse wire 4 and a fibre web 5 move on between the band surfaces facing each other. The fibre web 5 moves in the direction shown by arrow A. The first band 1 is arranged to turn around first turning rolls 6*a* and 6*b* provided at the ends of the drying apparatus. Correspondingly, the second band 2 is arranged to turn around second turning rolls 7*a* and 7*b* also provided at the ends of the drying apparatus below the first turning rolls 6*a* and 6*b*. The wires 3 and 4 are supported and guided by guide rolls 8. Since the pressure at the drying zone in the space between the bands 1 and 2 is usually different from the pressure prevailing outside or on the sides of the bands 1 and 2, seals are provided on both sides of the apparatus between the bands 1 and 2 or near the edges thereof, to prevent liquid or gas from escaping sideways out of the space between the bands 1 and 2, or vice versa. For the steam heating required by the drying process, the drying apparatus comprises a pressure chamber 9 that is situated above the first band 1. The first band 1 is sealed with seals 9*a* to the pressure chamber 9 so that the steam in the pressure chamber 9 has a suitable pressure. Below the second band 2 there is a water chamber 10 containing water that cools the second band 2. The edges of the water chamber 10 are provided with seals 10*a* with which the second band 2 is sealed to the water chamber 10.

The operation of the drying apparatus is based on heating the first band 1 in contact with the web 5 by hot steam contained in the pressure chamber 9, whereby water contained in the web 5 vaporizes due to the high temperature of the first band 1 and passes through the wires 3 and 4 towards the second band 2. The second band 2 is in turn cooled continuously by water arranged below it, whereby steam reaching the surface of the band will condense into water and is removed with the band 2 and the wire 4.

Saturated steam is supplied to the pressure chamber 9 via a pipe 11. In the pressure chamber 9, condensation water is collected from the surface of the band 1 with condensate recovery units 12. The condensate is discharged from the condensate recovery units 12 via discharge pipes 13. Water is supplied to the water chamber 10 via an inlet pipe 14. The cooling water used is discharged via a discharge pipe 15.

The wire 4 is provided with blow boxes 16*a* and suction boxes 16*b* with which humidity is removed from the wire 4. Water can be removed from the wire 4 by using either both the blow boxes 16*a* and the suction boxes 16*b* provided on opposite sides of the wire 4, or only one of these.

Before the fibre web 5 and the wires 3 and 4 run between the bands 1 and 2, they are supplied through an air exhaust unit 17 where air is removed from the pores of the web 5 and the wires 3 and 4 as carefully as possible for example by supplying superheated or saturated steam having a suitable temperature through them, the steam pushing the air molecules out of the pores and replacing them with water molecules of the steam.

There is a steam recovery chamber 18 in association with the pressure chamber 9 at the end where the bands 1 and 2 come into sight from between the pressure chamber 9 and the water chamber 10. The steam that escapes from the pressure chamber 9 from between the seal 9*a* and the heated band 1 can be collected to the steam recovery chamber 18. In a corresponding manner, condensate that flows out from between the seal 9*a* and the heated band 1 can be collected to the steam recovery chamber 18. Majority of the condensate vaporizes in the steam recovery chamber 18 under the influence of the heated band 1. The heat content of the steam can be recovered in a heat exchanger 45 from which the condensate is further supplied along a pipe 23 to a condensate tank 20. Steam obtained from side chambers 43 is supplied in a similar manner along a pipe 44 via the heat exchanger 45. The side chamber 43 is shown in FIG. 1 schematically by broken lines. Further, the water collected from the side chambers 43 is supplied to a recovery tank 25. The recovered water and steam are first supplied from the side chambers 43 to a collector basin from where the water and the steam are separately supplied for further use. For the sake of clarity, this arrangement is not shown in the accompanying figures. Also for the sake of clarity, the accompanying figure only shows one pipe 44 for conducting water and steam.

The condensate recovered via the pipe 13 from the condensate recovery units 12 is conducted to the condensate tank 20 with a pipe 19. It is self-evident that the discharge pipe 13 can also lead directly to the condensate tank 20, but for the sake of clarity, the accompanying figure shows the condensate being transferred from the discharge pipe 13 to the pipe 19.

Since this condensation water is so pure, it can be pumped with a pump 21 via a pipe 22 directly for use in a power station 22*a* for example as feed water in a low-pressure steam boiler 22*b*.

A condensate recovery unit 26 is provided on the surface of the cooled band 2 facing the wire 4 after the point where the cooled band 2 and the wire 4 separate. With this condensate recovery unit 26 it is possible to collect the condensate that has gathered on the surface of the cooled band 2 from the fibre web 5 through the wires 3 and 4. The condensate is supplied along a pipe 24 to the recovery tank 25. Condensate that has passed from the fibre web 5 to the wire 4 can also be recovered from the suction box 16*b*. The condensate contained in the suction box 16*b* can be transferred to the recovery tank 25 via a pipe 27.

The condensate collected from the fibre web 5 to the recovery tank 25 cannot be used as such for example as feed water in a steam boiler of a power station. Therefore, the water collected in the recovery tank 25 is first supplied from the tank by means of a pump 28 via a pipe 29 to the removal of solid matter. The removal of solid matter is carried out for example in such a way that the condensate is passed through a sand filter 30, so that the majority of the solid matter is removed from the condensate. The condensate is thereafter passed through a check filter 31 that is for example a cartridge filter, which ensures that water containing solid matter cannot pass forward in case of a possible breakdown of the sand filter 30. The condensate is thereafter supplied to a first heat exchanger 32 and further to a second heat exchanger 33 and from there to an ion exchanger 34. The first heat exchanger 32 and the second heat exchanger 33 are needed in the process to decrease the temperature of the condensation water. In the recovery tank 25 the temperature of the condensate can be for example 80° and the temperature of water supplied to the ion exchanger 34 may be typically only about 35°, for example. The ion exchanger 34 is used to purify the water of possible impurities, such as salts and other similar impurities. From the ion exchanger 34 the purified water is again supplied via a pipe 35 to the heat exchanger 32 with which the temperature of the water is again increased and the water is conducted via a pipe 36 to the condensate tank 20. The water to be purified and supplied to the ion exchanger 34 could naturally also be cooled in some other manner than with the first and the second heat exchanger 32 and 33, but when the heat exchanger 32 is used in accordance with the invention, the temperature of the water can be increased with the exchanger so that the need for heating the water supplied to a power station via the pipe 22 decreases essentially. The use of the first heat exchanger 32 in the manner set forth in the invention is very advantageous.

When the ion exchanger 34 is regenerated, for example, the water can be supplied directly past the heat exchangers 32 and 33 and the ion exchanger 34 along a by-pass pipe 37 to the condensate tank 20. Naturally before the condensation water can be supplied directly to the condensate tank 20 after the removal of solid matter, its conductivity must be measured so that sufficient purity of the water is ensured. In addition to the by-pass pipe 37, there may also be in this point a separate pipe along which water can be supplied to a hot water tank 42 containing raw water if the water is not sufficiently pure and the ion exchanger 34 is not used. This pipe is denoted with a broken line in accompanying FIG. 1. The arrangement can also be automated such that the conductivity of the water is measured continuously before the by-pass pipe 37 and on the basis of this measurement the water is conducted either to the ion exchanger 34 or via the by-pass pipe 37 directly to the condensate tank 20 or to the hot water tank 42. For the sake of clarity, the accompanying figure does not show these control, regulation, measurement and valve arrangements.

If desired, some of the water can be supplied from the pipe 22 along a regeneration water pipe 38 to the ion exchanger 34 as regeneration water. The temperature of this water must also be decreased to about 35°, for example, and this decrease in temperature can be carried out for example by means of a third heat exchanger 39. The water obtained from the regeneration water pipe 38 can therefore be used when the ion exchanger 34 is regenerated. Naturally, when the ion exchanger 34 is regenerated, pressurized air and reclaiming chemicals, such as hydrochloric acid or lye, are also added to the exchanger in a manner known per se. Also during the regeneration the water leaving the ion exchanger is supplied to a neutralization basin to which either hydrochloric acid or lye is added according to the degree of acidity of the water contained in the neutralization basin. Since the aforementioned materials and operations related to the regeneration of the ion exchanger 34 are known per se, they are not shown in the accompanying figure for the sake of clarity.

The heat obtained from the second heat exchanger 33 and the third heat exchanger 39 can be utilized for example for heating raw water such that raw water is supplied to the third heat exchanger 39 via the pipe 40 when regeneration water is supplied to the ion exchanger along the regeneration water pipe 38. The raw water heated with the third heat exchanger 39 is supplied to the hot water tank 42. In a corresponding manner, it is possible to supply raw water to the second heat exchanger 33 along a pipe 41. The raw water is also supplied from the third heat exchanger 33 to the hot water tank 42.

FIG. 2 shows schematically the edge of an apparatus according to the invention for drying a fibre web in a cross-section made in the direction of travel of the fibre web. The edges of the drying apparatus comprise side chambers 43 where it is possible to collect water and condensate that escape from between the seal 9*a* of the pressure chamber 9 and the first band 1 and cooling water that escapes from between the seals 10*a* of the water chamber 10 and the second band 2. From the side chamber 43 this steam and water is supplied for further use along one or several pipes 44. For the sake of clarity, FIG. 2 does not show the wires 3 and 4 or the fibre web 5.

The drawings and the related description are only intended to illustrate the inventive idea. The details of the invention may vary within the scope of the claims.

It is claimed:

1. A method for utilizing condensation water of an apparatus for drying a fibre web, the apparatus comprising two endless bands impermeable to air and having a good thermal conductivity, first turning rolls, the first band being arranged to turn around the first turning rolls, second turning rolls, the second band being arranged to turn around the second turning rolls, and a pressure chamber containing a pressure medium that is steam, the pressure chamber being arranged to heat the first band, whereby the second band is cooled and the fibre web and at least one felt or wire run between the bands in such a way that the fibre web is in contact with the heated first band and the felt or wire is correspondingly situated between the fibre web and the cooled second band, and that the water that has evaporated from the fibre web and then condensed is recovered, wherein the water that has evaporated from the fibre web and then condensed is supplied for use after the removal of solid matter.

2. A method according to claim 1, wherein condensate is collected from the surface of the heated first band and the gathered condensate is supplied for use as feed water in a steam boiler of a power station.

3. A method according to claim 1, wherein condensate is collected from the surface of the cooled band facing the wire, and the condensate is supplied for use as feed water in a steam boiler of a power station after the removal of solid matter.

4. A method according to claim 1, wherein the condensation water that has passed through the removal of solid matter is supplied through an ion exchanger before it is supplied for use.

5. A method according to claim 1, wherein after the removal of solid matter, the purity of the condensation water is measured and the condensation water is supplied for use directly on the basis of the measurement.

6. An arrangement for utilizing condensation water of an apparatus for drying a fibre web, the apparatus comprising two endless bands impermeable to air and having a good thermal conductivity, first turning rolls, the first band being arranged to turn around the first turning rolls, second turning rolls, the second band being arranged to turn around the second turning rolls, and a pressure chamber containing a pressure medium that is steam, the pressure chamber being arranged to heat the first band, whereby the second band is cooled and the fibre web and at least one felt or wire run between the bands in such a way that the fibre web is in contact with the heated first band and the felt or wire is correspondingly situated between the fibre web and the cooled second band, the arrangement comprising suction boxes for removing condensate from the felt or wire and means for conducting the condensate to means for removing solid matter and from there for use.

7. An arrangement according to claim 6, wherein the surface of the heated band is provided with condensate recovery units, the arrangement further comprising means for supplying the condensate gathered from the condensate recovery units for use as feed water in a steam boiler of a power station.

8. An arrangement according to claim 6, the arrangement further comprising a condensate recovery unit for collecting condensate from the surface of the cooled band facing the wire, and means for conducting said condensate to the means for removing solid matter and thereafter for use.

9. An arrangement according to claim 6, the arrangement further comprising an ion exchanger through which the condensate can be passed after the removal of solid matter.

10. A method according to claim 1, wherein after the removal of solid matter, the purity of the condensation water is measured and the condensation water is supplied for use via the ion exchanger on the basis of the measurement.

* * * * *